US007249556B2

(12) United States Patent
Koelzer et al.

(10) Patent No.: US 7,249,556 B2
(45) Date of Patent: Jul. 31, 2007

(54) COMPRESSOR WITH FORTIFIED PISTON CHANNEL

(75) Inventors: Robert L. Koelzer, Kearney, MO (US); Michael R. Jenkins, Kansas City, MO (US); Mark D. Schaake, Bonner Springs, KS (US); Andrew W. Adams, Less's Summit, MO (US)

(73) Assignee: Haldex Brake Corporation, Kansas City, MO (US)

( * ) Notice: Subject to any disclaimer, the term of this patent is extended or adjusted under 35 U.S.C. 154(b) by 311 days.

(21) Appl. No.: 10/998,450

(22) Filed: Nov. 29, 2004

(65) Prior Publication Data

US 2006/0115367 A1 Jun. 1, 2006

(51) Int. Cl.
*F01B 1/02* (2006.01)

(52) U.S. Cl. ..... 92/72; 92/138

(58) Field of Classification Search ..... 92/72, 92/74, 76, 138, 140; 417/415, 534, 539
See application file for complete search history.

(56) References Cited

U.S. PATENT DOCUMENTS

| | | | | |
|---|---|---|---|---|
| 1,465,647 | A | 8/1923 | Ludlam | 92/160 |
| 1,782,317 | A | 11/1930 | Royce et al. | |
| 2,464,652 | A | 3/1949 | Petersen | 123/173 |
| 3,973,547 | A | 8/1976 | Weiss | 123/193 |
| 4,360,319 | A | 11/1982 | Paget | 417/238 |
| 4,365,593 | A | 12/1982 | Pomfret | 123/41.32 |
| 4,530,323 | A | 7/1985 | Wakasa | 123/41.77 |
| 4,614,169 | A | 9/1986 | Figliuzzi | 123/54 |
| 4,756,239 | A | 7/1988 | Hattori et al. | 92/71 |
| 5,076,764 | A | 12/1991 | Kawai et al. | 417/269 |
| 5,567,121 | A | 10/1996 | Peterson | 417/63 |
| 5,868,107 | A | 2/1999 | Betsch et al. | 123/41.82 |
| 6,152,090 | A | 11/2000 | Fujimoto et al. | 123/41.74 |
| 6,280,158 | B1 | 8/2001 | Itoh et al. | 417/423.8 |
| 6,283,081 | B1 | 9/2001 | Ozeki | 123/193.2 |
| 6,485,265 | B2 | 11/2002 | Schroeder et al. | 417/63 |

(Continued)

FOREIGN PATENT DOCUMENTS

EP 1538052 A2 * 6/2005

OTHER PUBLICATIONS

International Search Report And Written Opinion; Apr. 13, 2006; 6 pages.

*Primary Examiner*—Igor Kershteyn
(74) *Attorney, Agent, or Firm*—St. Onge Steward Johnston & Reens LLC

(57) ABSTRACT

A compressor is disclosed generally comprising a cylinder head mounted to a cylinder block having a cooling chamber and a piston channel via a bolt. A piston is disposed in the piston channel and has a contact portion that contacts the channel wall, which is integrally formed with the cylinder block, as it slides within the channel. The bolt and the cooling chamber each extend from at least as high as the highest contact point between the contact portion of the piston and the channel wall to at least as low as the lowest contact point between the contact portion of the piston and the channel wall. In certain embodiments, the cooling chamber is located between the bolt and the piston channel. In some embodiments, a crankcase is integrally formed with the cylinder block.

20 Claims, 2 Drawing Sheets

U.S. PATENT DOCUMENTS

| | | | | |
|---|---|---|---|---|
| 6,513,506 | B1 | 2/2003 | Ito et al. | 123/568.13 |
| 2003/0098005 | A1 | 5/2003 | Ito et al. | 123/193.5 |
| 2003/0111026 | A1 | 6/2003 | Baba et al. | 123/41.82 |
| 2003/0230254 | A1 | 12/2003 | Matsutani et al. | 123/41.79 |
| 2004/0086402 | A1 | 5/2004 | Takehana et al. | 417/423.1 |
| 2004/0120839 | A1 | 6/2004 | Dunaevsky et al. | 417/569 |

* cited by examiner

COMPRESSOR WITH FORTIFIED PISTON CHANNEL

FIELD OF THE INVENTION

The present invention relates to an apparatus for generating compressed fluid. More specifically, the invention relates to a compressor that limits deformation and excessive heating of its piston channels.

BACKGROUND OF THE INVENTION

As is well known, various parts of certain vehicles require the use of compressed fluid, such as compressed air, for their operation. For example, the brake systems of trucks and other large vehicles often use compressed air to bias various braking mechanisms, such as spring-based actuators, into braking and non-braking positions.

Accordingly, piston compressors are generally known in the art for generating this compressed fluid. These compressors typically employ a cylinder block with a plurality of piston channels. A plurality of pistons are slidably disposed in the piston channels and are coupled to some mechanism, such as a crankshaft, for causing them to reciprocate back and forth within the piston channels, thereby alternately creating suction and compression strokes. As the pistons reciprocate within the piston channels of the cylinder block, they alternately draw fluid to be compressed into the channels, and subsequently compress and discharge this fluid.

In order to control the introduction and discharge of fluid to and from the piston channels, these compressors also typically include a compressor head having inlet and outlet ports, as well as inflow and outflow channels connecting the ports to the piston channels. Additionally, the compressor heads often include valves, or else separate valve plates are disposed between the compressor head and the cylinder block having such valves, which regulate the inflow and outflow of the fluid. These valves permit the piston channels to communicate with the inlet and outlet channels, and ultimately, the inlet and outlet ports, in the compressor head.

However, one problem with these compressors is that the walls of the piston channels will sometimes become distorted during assembly of the compressor. As previously noted, a cylinder head is typically mounted to the cylinder block by a set of fasteners, usually by inserting a series of bolts through the cylinder head and into threaded openings in the cylinder block. As the head and the block are clamped together by tightening the bolts, the clamping force will often distort the walls of the piston channels adjacent thereto. Uneven application of the tightening forces to the various bolts positioned around the block can further exacerbate this distortion. Additionally, the channel wall with which the piston makes contact as it slides along the channel is often a liner placed within a cylinder bore, which is typically even more prone to distortion.

Distortion of the piston channel walls is a serious problem, as it affects the seal between the piston and the channel wall. For example, often the pistons will include a set of compression rings coupled to the piston head, the annular shape of which engages the cylindrical shape of the piston channel and thereby prevents the passage of oil from the compressor to the fluid compression chambers above the piston head. If the channel wall becomes distorted, and thus, the channel wall is no longer cylindrical, the engagement between the compression rings and the channel wall is less than perfect. This loss of a continuous seal will result in leakage of oil into the compression chamber above the cylinder, which can contaminate the compressed fluid and can affect the components downstream of the compressor. For example, often, an air dryer is used in conjunction with the compressor to remove moisture in the air being supplied by the compressor before it is supplied to the relevant parts of the vehicle. If oil leaks into the compression chamber above the piston head, this oil will contaminate the air dryer system when the compressed air is communicated to it. As another example, if the leaked oil proceeds to the air control valves, it can prevent them from working properly.

Similarly, the piston heads in these types of compressors are also commonly fitted with oil scraper rings that contact the walls of the piston channels. After oil has been deposited on the channel walls due to the exposure of those walls to the oil during the pistons' upward compression strokes, the oil scraper rings serve to scrape the oil off of the walls during the pistons' downward suction strokes, thereby helping to ensure that this oil does not ultimately end up in the compression chambers above the piston heads. However, when the piston channel walls become distorted, the scraper rings, much like the compression rings, are effectively lifted off of the surface of the channel wall, thereby decreasing their ability to scrape the oil therefrom.

A related problem that exists with these types of compressors is that, as the pistons slide within the piston channels, the continuous sliding contact made between part of the piston and the wall of the channel causes the channel wall to heat up. This increase in temperature causes the channel walls to be even more prone to distortion as a result of additional stresses placed on the channel walls by the clamping force of the bolts.

Another problem that results from these types of compressors is that, even if the heat resulting from the friction between the piston and the channel wall does not cause the channel wall to become deformed, it ends up heating the air that is being compressed at the top of the piston channel, which can lead to numerous problems. For example, as previously mentioned, an air dryer is often used in conjunction with the compressor to remove moisture in the air being supplied by the compressor to the relevant parts of the vehicle. Because the air is hotter, it is able to hold more water vapor, and therefore, the air dryer must work harder to remove the moisture. Another problem created by this additional heat is that it causes oil to be more prone to "coking up"—burning and leaving behind carbon deposits. Yet another problem caused by excessive amounts of very hot air is that components of the compressor, and downstream from the compressor, will tend to have a shorter life, in part because of contraction and expansion of those parts from unnecessary levels of heating and cooling.

What is desired, therefore, is a piston compressor where the walls of the piston channels do not become easily deformed. What is further desired is a piston compressor where the walls of the piston channels do not become excessively hot.

SUMMARY OF THE INVENTION

Accordingly, it is an object of the present invention to provide a piston compressor in which the process of fastening the cylinder head to the cylinder block does not deform the piston channels.

It is a further object of the present invention to provide a piston compressor that includes structural consistency along the length of the piston channel.

It is yet another object of the present invention to provide a piston compressor that counteracts the heating effect of friction along the length of the friction producing surface.

In order to overcome the deficiencies of the prior art and to achieve at least some of the objects and advantages listed, the invention comprises a compressor including a cylinder block, a cylinder head mounted adjacent the cylinder block, a bolt mounting the cylinder head adjacent the cylinder block, a piston channel formed in the cylinder block, the piston channel having a wall integrally formed with the cylinder block, and a cooling chamber formed in the cylinder block adjacent the piston channel for accommodating a fluid, and a piston slidably disposed in the piston channel, the piston having a contact portion for contacting the wall of the piston channel as the piston slides from a highest position to a lowest position, wherein the bolt and the cooling chamber each extend from at least the point of contact between the contact portion of the piston and the wall of the piston channel when the piston is in the highest position to at least the point of contact between the contact portion of the piston and the wall of the piston channel when the piston is in the lowest position.

In another embodiment, the invention comprises a compressor including a cylinder block, a cylinder head mounted adjacent the cylinder block, a bolt mounting the cylinder head adjacent the cylinder block, a piston channel formed in the cylinder block, the piston channel having a wall integrally formed with the cylinder block, and a cooling chamber formed in the cylinder block adjacent the piston channel for accommodating a fluid, a crankcase integrally formed with the cylinder block, a crankshaft at least partially disposed in the crankcase, and a piston coupled to the crankshaft and slidably disposed in the piston channel, the piston having a contact portion for contacting the wall of the piston channel as the piston slides from a highest position to a lowest position, wherein the bolt and the cooling chamber each extend from at least the point of contact between the contact portion of the piston and the wall of the piston channel when the piston is in the highest position to at least the point of contact between the contact portion of the piston and the wall of the piston channel when the piston is in the lowest position.

In yet another embodiment, the invention comprises a compressor including a housing, the housing having a bolt recess, a piston channel formed in the housing, the piston channel having a wall integrally formed with the housing, a cooling chamber formed in the housing adjacent the piston channel for accommodating a fluid, a piston slidably disposed in the piston channel, the piston having a contact portion for contacting the wall of the piston channel as the piston slides from a highest position to a lowest position, and a bolt disposed in the bolt recess of the housing, wherein the bolt and the cooling chamber each extend from at least the point of contact between the contact portion of the piston and the wall of the piston channel when the piston is in the highest position to at least the point of contact between the contact portion of the piston and the wall of the piston channel when the piston is in the lowest position.

DETAILED DESCRIPTION OF THE DRAWINGS

Figure 1:
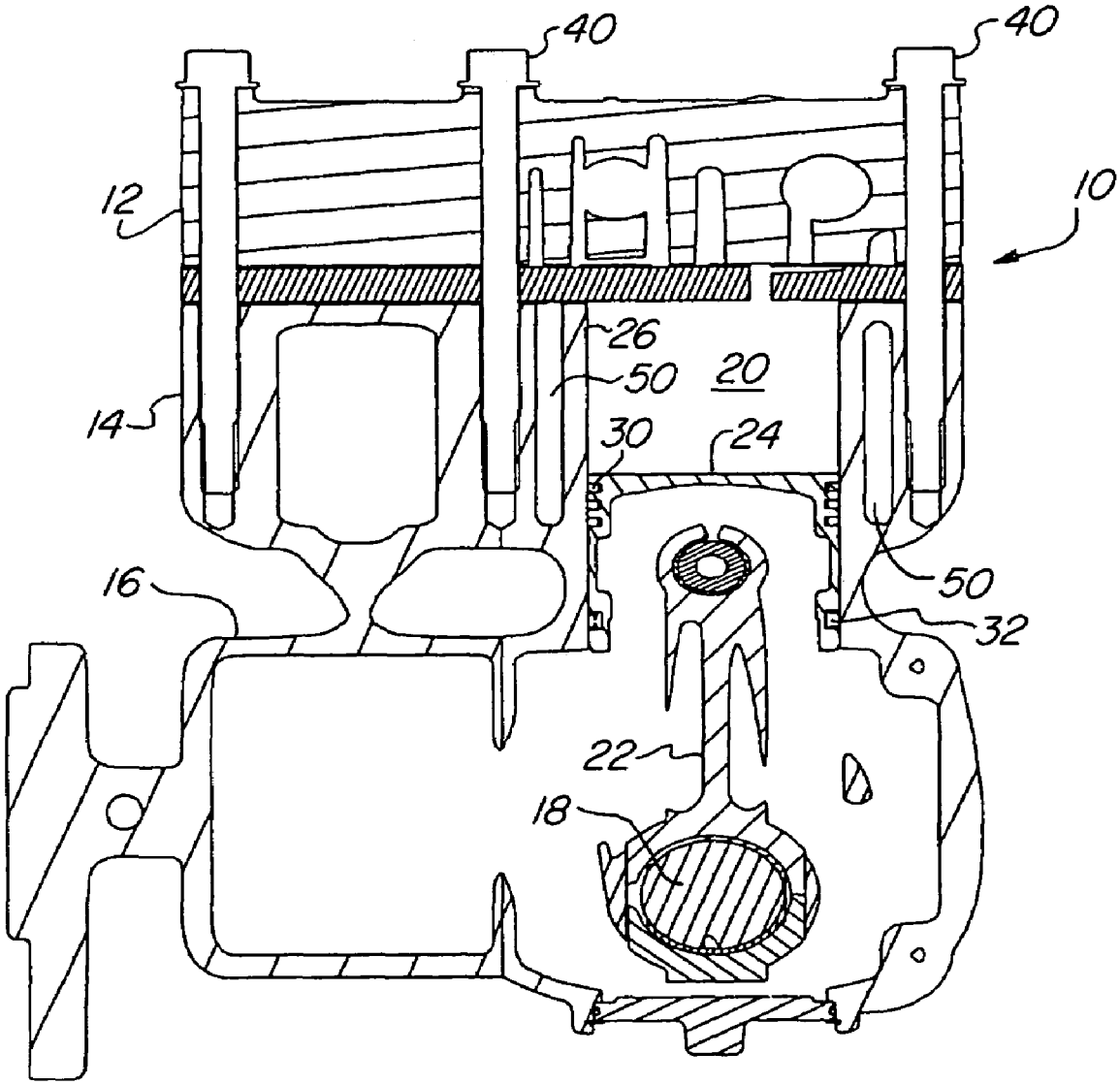
FIG. 1 is end, cross-sectional view of a compressor with a fortified piston channel in accordance with the invention.

The basic components of one embodiment of a compressor 10 in accordance with the invention are illustrated in FIG. 1. As used in the description, the terms "top," "bottom," "above," "below," "over," "under," "above," "beneath," "on top," "underneath," "up," "down," "upper," "lower," "front," "rear," "back," "forward" and "backward" refer to the objects referenced when in the orientation illustrated in the drawings, which orientation is not necessary for achieving the objects of the invention.

Figure 2:
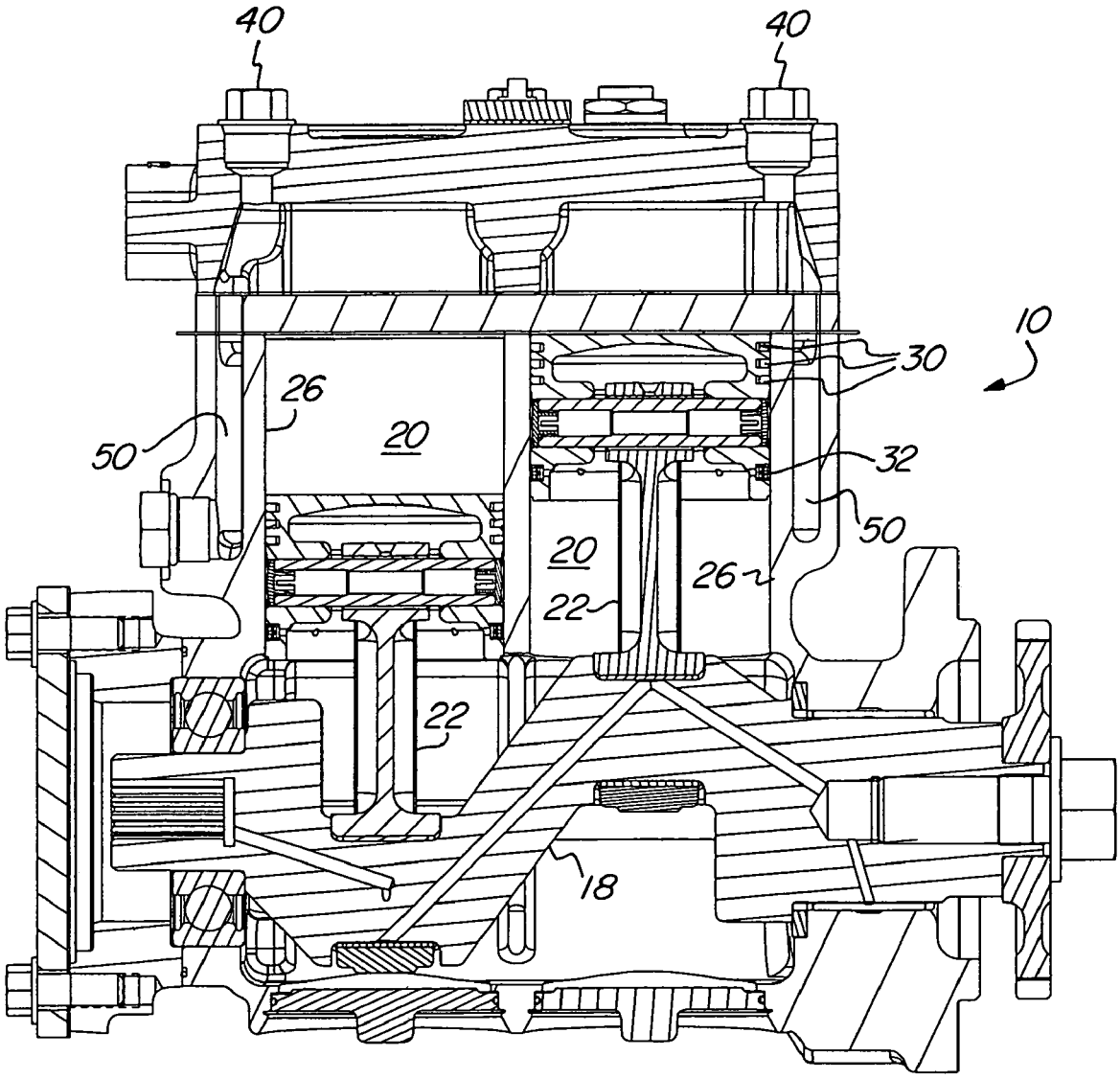
FIG. 2 is front cross-sectional view of the compressor of FIG. 1.

The compressor 10 includes a cylinder head 12 mounted to a cylinder block 14. In certain advantageous embodiments, a crankcase 16 is integrally formed with the cylinder block 14. A crankshaft 18 is disposed in the crankcase 16. The cylinder block 14 has at least one piston channel 20 formed therein, and often, as illustrated in FIG. 2, has a plurality of piston channels 20. A piston 22 is disposed in each piston channel 20 and is coupled to the crankshaft 18, which causes the pistons 22 to reciprocate back and forth within the channels 20 as it rotates.

The pistons 22 are reciprocally displaceable within the channels 20 in order to provide for suction and compression strokes. A space in the channels 20 above the pistons 22 is in fluid communication with the air system requiring the compressed fluid. During the downstroke of the piston 22, air is drawn into the channel 20. During the subsequent upstroke of the piston 22, this air is compressed and then discharged from the channel 20. In order to regulate the entry and discharge of this air from the compression space above the pistons 22, the cylinder head 12, which typically includes an arrangement of inlet and outlet apertures, channels, and valves, is mounted adjacent the cylinder block 14.

Each piston 22 has a piston head 24, which engages a wall 26 of the piston channel 20. Usually, the channel wall 26 is cylindrical, and the piston head 24 engages the channel wall 26 via an annular member 30 coupled to the piston head 24. In certain advantageous embodiments, the annular member 30 is a compression ring. In some embodiments, a plurality of compression rings 30 are coupled to the piston head 24.

The compression rings 30 directly contact the channel wall 26, which is integrally formed with the cylinder block 14. This can be created in any of various ways, but is often accomplished by starting with a solid piece, such as an iron block, and boring or extruding piston channels therein. Alternatively, a cylinder block having cylindrical channels therein may simply be cast by a mold having that shape. Because this integral wall serves as the piston channel wall 26, there is much less likelihood that the shape of the piston channel 20—which corresponds to the shape of the annular compression rings 30—will become deformed than if a separate liner or casing where placed in a bore.

The cylinder head 12 is mounted to the cylinder block 14 by at least one bolt 40. The bolts 40 extend from at least the highest point of contact between the compression ring 30 and the channel wall 26 (i.e., the position of the ring 30 when the piston 22 is in the highest position of its upstroke) to the lowest point of contact between the ring 30 and wall 26 (i.e., the position of the ring 30 when the piston 22 is in the lowest position of its downstroke). In this way, the structural integrity of the block 14 adjacent the channel 20 remains consistent along the moving entire path of the ring 30, and the final tightening occurring at the bottom of the bolt 40 does not occur along this path.

A cooling chamber 50, which is typically a water jacket, is formed in the cylinder block 14. As in the case of the piston channels 20, the cooling chamber 50 can be created in any of various ways, including boring, extrusion, and casting. The cooling chamber 50 is positioned adjacent the piston channel 20 and, in certain advantageous embodiments, the chamber 50 is encircles the channel 20. Accordingly, the chamber can be filled with a fluid, such as water, to help cool the channel 20 as the wall 26 heats up due to the friction between the wall 26 and the compression rings 30 as the piston 22 reciprocates back and forth within the piston channel 20.

In some embodiments, the cooling chamber is located between the bolt 40 and the channel 20. Accordingly, the chamber 50 is closer, and therefore, better able to cool, the channel 20. Moreover, the bolt is further away from, and therefore, less likely to exert excessive force on, the channel 20. Finally, the cooling chamber 50 is able to absorb any stress exerted in the direction of the channel 20 as a result of tightening of the bolt 40 before it affects the channel 20. In order to maximize the cooling effect on the wall 26 and the insulating effect against the clamping force of the bolt 40, the cooling chamber 50, like the bolts 40, extends from at least the highest point of contact between the compression ring 30 and the channel wall 26 to the lowest point of contact between the ring 30 and wall 26. In this way, the entire path of the ring 30 can be effectively cooled by the fluid in the chamber 50.

In certain advantageous embodiments, at least one oil scraper ring 32 is also coupled to the piston head 24. When the piston 22 slides upward in the channel 20 during a compression stroke, part of the wall 26 becomes exposed to oil present in the crankcase 16, which can become deposited thereon. Accordingly, during the downward suction stroke of the piston 22, the oil scraper ring 32 helps to scrape any oil remaining on the wall 26 back down into the crankcase 16 before the compression rings 30 come into contact with the oil.

Though the invention has been shown in connection with a reciprocating compressor, in other embodiments, the invention involves other types of compressors, such as swash plate compressors. In these embodiments, instead of a crankshaft to which the piston stems are coupled, a drive shaft is axially aligned with, and positioned in the center of, the compressor. The pistons are coupled to a swash plate, which is mounted to the drive shaft, thereby converting the rotational motion of the shaft into axial motion of the pistons, such as the design disclosed in U.S. Pat. No. 6,439,857 to Koelzer and assigned to the assignee of the present application. As shown therein, is some embodiments, the swash plate includes a rotating portion (mounted to the shaft) coupled to a non-rotating portion (coupled to the pistons) via a bearing, and an actuator is provided for contacting the swash plate, such that the actuator, when in a first position, exerts a force on the swash plate appropriate to retain the swash plate in a position perpendicular to the shaft, such that the piston remains idle, and, when in a second position, exerts a force on the swash plate appropriate to pivot the swash plate, thereby causing reciprocal motion of the piston within the piston channel.

Similarly, though the invention has been shown in conjunction with a standard reciprocating compressor, in other embodiments, the invention is employed with compressors that have separate pistons and piston channels located on opposite sides of the crankshaft, and thus, receive and discharge fluid from both ends of the compressor.

It should be understood that the foregoing is illustrative and not limiting, and that obvious modifications may be made by those skilled in the art without departing from the spirit of the invention. Accordingly, reference should be made primarily to the accompanying claims, rather than the foregoing specification, to determine the scope of the invention.

What is claimed is:

1. A compressor, comprising:

a cylinder block;

a cylinder head mounted adjacent said cylinder block;

a bolt mounting said cylinder head adjacent said cylinder block;

a piston channel formed in said cylinder block, said piston channel having a wall integrally formed with said cylinder block, and a cooling chamber formed in said cylinder block adjacent said piston channel for accommodating a fluid;

a crankcase and said cylinder block are formed as a unitary monoblock, a crankshaft at least partially disposed in said crankcase; and a piston coupled to said crankshaft and slidably disposed in said piston channel, said piston having a contact portion for contacting the wall of said piston channel as said piston slides from a highest position to a lowest position;

wherein said bolt and said cooling chamber each extend from at least the point of contact between the contact portion of said piston and the wall of said piston channel when said piston is in the highest position to at least the point of contact between the contact portion of said piston and the wall of said piston channel when said piston is in the lowest position.

2. The compressor of claim 1, wherein said cooling chamber is located between said piston channel and said bolt.

3. The compressor of claim 2, wherein said cooling chamber encircles said piston channel.

4. The compressor of claim 1, wherein said cooling chamber comprises a water jacket.

5. The compressor of claim 1, wherein said piston channel is cylindrical.

6. The compressor of claim 5, wherein said piston includes a piston head, and wherein said contact portion comprises at least one annular member coupled to said piston head.

7. The compressor of claim 6, wherein said annular member comprises a compression ring.

8. The compressor of claim 7, further comprising at least one additional compression ring coupled to said piston head.

9. The compressor of claim 7, further comprising at least one oil scraper ring coupled to said piston head.

10. A compressor, comprising:

a housing, said housing having a bolt recess;

a piston channel formed in said housing, said piston channel having a wall integrally formed with said housing;

a cooling chamber formed in said housing adjacent said piston channel for accommodating a fluid;

a crankcase and said cylinder block are formed as a unitary monoblock, a crankshaft at least partially disposed in said crankcase;

a piston coupled to said crankshaft and slidably disposed in said piston channel, said piston having a contact portion for contacting the wall of said piston channel as said piston slides from a highest position to a lowest position; and a bolt disposed in the bolt recess of said housing;

wherein said bolt and said cooling chamber each extend from at least the point of contact between the contact portion of said piston and the wall of said piston channel when said piston is in the highest position to at least the point of contact between the contact portion of said piston and the wall of said piston channel when said piston is in the lowest position.

11. The compressor of claim 10, wherein said cooling chamber is located between said piston channel and said bolt.

12. A compressor, comprising:

a cylinder block;

a crankcase and said cylinder block are formed as a unitary monoblock, a cylinder head mounted adjacent said cylinder block;

a bolt mounting said cylinder head adjacent said cylinder block;

a piston channel formed in said cylinder block, said piston channel having a wall integrally formed with said cylinder block, and a cooling chamber formed in said cylinder block adjacent said piston channel for accommodating a fluid;

a crankshaft at least partially disposed in said crankcase; and a piston driven by said crankshaft, wherein said piston is slidably disposed in said piston channel, said piston having a contact portion for contacting the wall of said piston channel as said piston slides from a highest position to a lowest position;

wherein said bolt and said cooling chamber each extend from at least the point of contact between the contact portion of said piston and the wall of said piston channel when said piston is in the highest position to at least the point of contact between the contact portion of said piston and the wall of said piston channel when said piston is in the lowest position.

13. The compressor of claim 12, wherein said piston includes a piston head that defines a compression chamber in said piston channel in which air is compressed as said piston moves from the lowest position to the highest position.

14. The compressor of claim 13, wherein said cooling chamber is located between said piston channel and said bolt.

15. The compressor of claim 13, wherein said cooling chamber encircles said piston channel.

16. The compressor of claim 13, wherein said cooling chamber comprises a water jacket.

17. The compressor of claim 13, wherein said piston includes a piston head, and wherein said contact portion comprises at least one annular member coupled to said piston head.

18. The compressor of claim 17, wherein said annular member comprises a compression ring.

19. The compressor of claim 18, further comprising at least one additional compression ring coupled to said piston head.

20. The compressor of claim 18, further comprising at least one oil scraper ring coupled to said piston head.

* * * * *